US006655769B2

(12) United States Patent
Sawano

(10) Patent No.: US 6,655,769 B2
(45) Date of Patent: Dec. 2, 2003

(54) IMAGE RECORDING METHOD AND A PRINTER USING THE SAME

(75) Inventor: Mitsuru Sawano, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/984,851

(22) Filed: Oct. 31, 2001

(65) Prior Publication Data

US 2002/0093543 A1 Jul. 18, 2002

(30) Foreign Application Priority Data

Oct. 31, 2000 (JP) ..... 2000-332256

(51) Int. Cl.[7] ..... B41J 2/015; B41J 2/04; B41J 2/045; B41J 2/11

(52) U.S. Cl. ..... 347/5; 347/9; 347/75

(58) Field of Search ..... 347/54, 68, 75, 347/1, 2, 5, 9, 15, 10

(56) References Cited

FOREIGN PATENT DOCUMENTS

JP 2002225260 A * 8/2002 ..... B41J/2/015

OTHER PUBLICATIONS

Hiroshi Fukumoto, et al., "Multi–gradation Ink–Jet Recording Using Mists Jetted out by Converging Ultrasonic Waves", '99 Proceedings of Japan Hard Copy, 1999, pp. 343–346.

* cited by examiner

*Primary Examiner*—Huan Tran
(74) *Attorney, Agent, or Firm*—Sughrue Mion, PLLC

(57) ABSTRACT

A printer selectively ejects ink droplets or jets out ink mists depending upon input data of an image to be recorded. The printer has a drive signal generating section and a recording head. The drive signal generating section generates two drive signals, first one for causing the recording head to eject ink droplets to record edge portions of a solid tone level of gradation in the image and the second one for causing the recording head to jet out ink mists to record portions in the image other than the edge portions. The first signal has lower frequency than the second signal.

The recording head has liquid ink chambers, each of which has an ink nozzle. A liquid level of ink in each liquid ink chamber is controlled when the first signal or the second signal is applied to the recording head.

10 Claims, 5 Drawing Sheets

IMAGE RECORDING METHOD AND A PRINTER USING THE SAME

BACKGROUND OF THE INVENTION

This invention relates to a method of recording image with ink droplets and ink mists. The invention also relates to a printer using the method.

Various types of ink-jet printer have been proposed to date and they share the common feature of ejecting ink droplets for dotting to paper or the like to record image. In recent years, the array density of ink nozzles on the recording head of the ink-jet printer has been increased to provide higher resolution and this has contributed to producing a sharp image having a comparatively large number of tone levels of gradation. On the other hand, the volume of each ink droplet that is ejected is still large, generally at least one picoliter (pL), so with the increase of the array density (dot density) of ink droplets ejected, it takes more time to dry the paper or the like on which image has been recorded by densely deposited ink droplets and this makes the ink-jet printer unsuitable for high-speed recording (printing).

It has been proposed to equip a printer with a preheating means that heats the paper or the like prior to recording so that the deposited ink can be dried in a short enough time but this has not necessarily attained the desired result. In order to meet the future demands for higher dot density of ink droplets and faster printing, it is essential to realize rapid drying of the recording paper or the like.

Very recently, it has been proposed to record image by jetting out ink mists in an amount of about 0.1 pL against paper or the like (Hiroshi Fukumoto et al. "Multi-gradation Ink-Jet Recording Using Mists jetted out by Converging Ultrasonic Waves", '99 Proceedings of Japan Hard Copy, 1999, pp. 343–346). In this method, ink mists each of which consists of a mass of fine ink drops are applied to record dots, thereby controlling the gradation density of each dot to be represented in multiple tone levels of gradation. It is said that the use of ink mists rather than ink droplets permits image gradation to be represented smoothly enough to achieve a substantial improvement in image granularity.

Since jetted ink mists are deposited on paper or the like in amounts of about 0.1 pL, the drying of ink would be fast enough to permit high-speed printing. On the other hand, the fine ink drops of an ink mist are not controlled individually but a plurality of the fine ink drops are simultaneously jetted out to pour like a shower until they are deposited in a specified area of paper or the like; hence, the edges of line images or those of a solid tone level of gradation cannot be reproduced sharply.

SUMMARY OF THE INVENTION

An object, therefore, of the present invention is to provide a method which not only permits fast drying of ink to realize high-speed printing but also enables the edge portions of a solid tone level of gradation in a image to be recorded sharply.

Another object of the invention is to provide a printer using the method.

These objects may be achieved, in the first aspect of invention, by providing an image recording method for recording an image having edge portions of a solid tone level of gradation therein, having steps of; recording the edge portions with dots to form a solid tone; recording portions in the image other than the edge portions using ink mists that are generated by converging ultrasonic waves in ink.

Preferably, the edge portions are recorded using ink droplets.

The solid tone is a tone which is formed by dotting without any space left for dotting on image recording to obtain the highest density that dots can represent.

The image includes not only an image having multiple tone levels of gradation such as photographed image, but also an image composed of lines, characters and their combinations which have a single solid tone level.

In the second aspect, the invention provides a printer having a recording head which ejects ink droplets or jets out ink mists selectively, depending upon input data of an image.

The printer preferably has a drive signal generating section which, depending upon the input data, generates a first drive signal for causing the recording head to eject ink droplets or a second drive signal for causing the recording head to jet out ink mists and the drive signal generating section applies either the first drive signal or the second drive signal to the recording head.

Additionally, the drive signal generating section preferably generates the first drive signal for edge portions of a solid tone level of gradation in the image to be recorded and generates the second drive signal for portions other than the edge portions.

Then the first drive signal preferably has lower frequency than the second drive signal.

Preferably, the recording head has liquid ink chambers each of which has an ink nozzle through which ink droplets are ejected or ink mists are jetted out selectively, and signal values of the first drive signal and the second drive signal are controlled such that a liquid level of ink in each liquid ink chamber is brought into registry with an outlet surface of the ink nozzle when the second drive signal is applied to the recording head whereas the liquid level in the liquid ink chamber is made lower than the outlet surface of each ink nozzle when the first drive signal is applied to the recording head.

Additionally, the edge portions are preferably detected on pixel basis of the image to find pixels which differ from adjacent pixels by tone level of gradation exceeding a specified value.

In the third aspect, the invention provides a printer having at least two recording heads, a first being a recording head which records edge portions of a solid tone level of gradation in an image to be recorded with dots to form a solid tone, and a second being a recording head which records portions in the image other than the edge portions using ink mists that are generated by converging ultrasonic waves in ink.

Preferably, the edge portions are detected on pixel basis of the image to find pixels which differ from adjacent pixels by tone level of gradation exceeding a specified value.

DESCRIPTION OF THE PREFERRED EMBODIMENTS

On the pages that follow, an example of the printer according to the second aspect of the invention which implements the image recording method according to its first aspect using ink mists and ink droplets is described in detail with reference to the preferred embodiments shown in the accompanying drawings.

Figure 1:
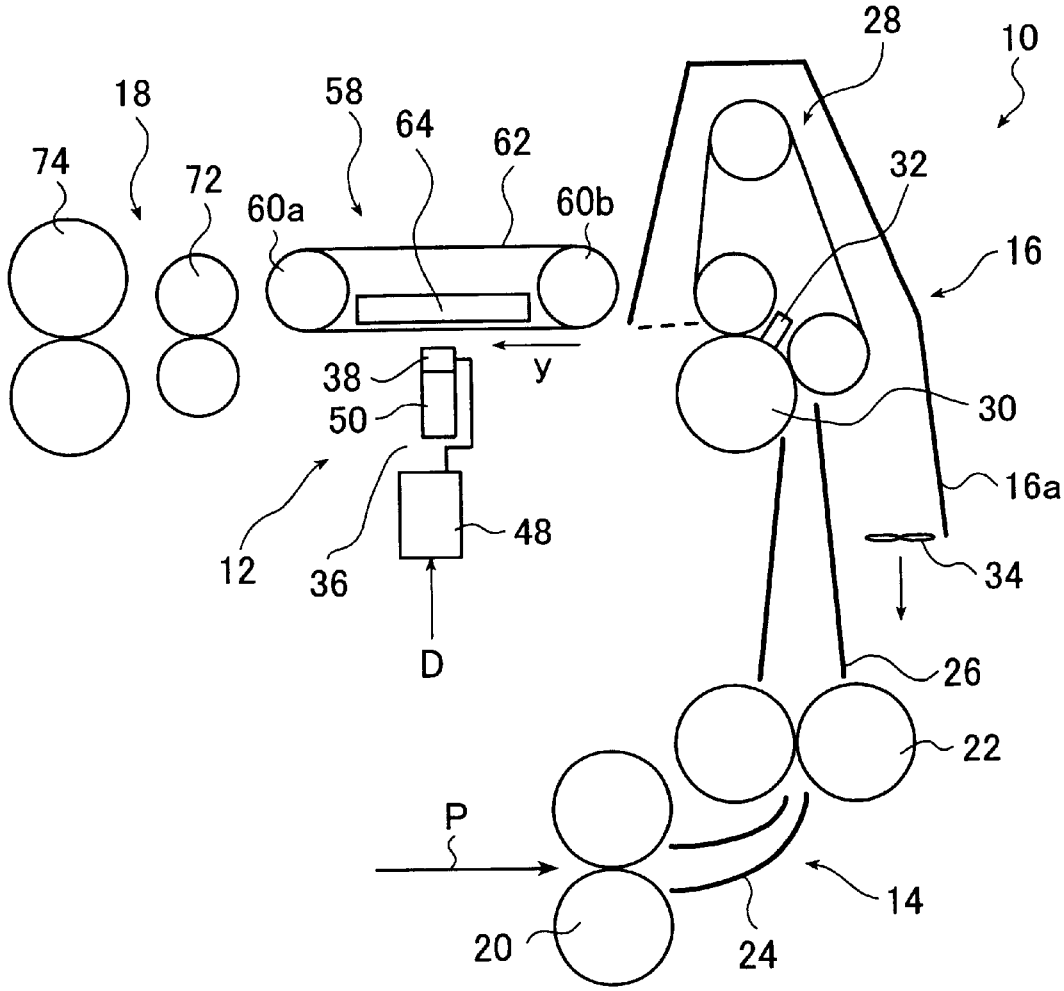
FIG. 1 illustrates the layout of an example of the printer according to the second aspect of the invention.

The printer is generally indicated by 10 in FIG. 1 and it consists basically of a recording section 12, a supply section 14, a preheating section 16, and a discharge section 18.

The supply section 14 comprises transport roller pairs 20 and 22, as well as guides 24 and 26. A recording medium P as fed transversely into the supply section 14 is gradually transported upward and fed into the preheating section 16.

The preheating section 16 comprises the following basic components: a conveyor 28 comprising an endless belt stretched around three rollers; a pressure roller 30 that is urged against the endless belt from outside of the conveyor 28; a heater 32 that is urged against the pressure roller from inside of the conveyor 28; and an exhaust fan 34 for evacuating air in the interior of the preheating section 16.

By heating the recording medium P prior to recording with ink jets, the preheating section 16 promotes the drying of the ink later deposited on the recording medium P and this contributes to realizing high-speed recording. The recording medium P transported from the supply section 14 is heated from the recording surface side by means of the heater 32 as it is held between the conveyor 28 and the pressure roller 30 and forwarded to the recording section 12.

The recording section 12 comprises a recording head unit 36 having a plurality of arrayed ink nozzles directed to the recording medium P, and a recording medium transport unit 58. The recording head unit 36 comprises a recording head 38, a signal generating portion 48 which uses data D to generate drive signals to be applied to the recording head 38, and an ink tank 50 from which ink I is supplied to the recording head 38. The ink nozzles on the recording head 38 are arranged to face away from the paper of FIG. 1 in a direction normal to it. For details of the recording head unit 36, see below.

The recording medium transport unit 58 comprises a transport belt 62 and a suction box 64. The transport belt 62 has a plurality of suction ports that are provided in both longitudinal and transverse directions at given spacings and it is moved by means of rollers 60*a* and 60*b*. The suction box 64 sucks the recording medium P by creating vacuum through the suction ports 62 in the transport belt 62. During recording with the recording head 38, the recording medium P is transported in the y direction by means of the transport belt 62. In the embodiment under consideration, the recording medium transport unit 58 is such a transport mechanism that the recording medium P is transported as the vacuum created in the suction box 64 is applied from above. However, this is not the sole case of the invention and any other known types of transport mechanism may be employed.

The discharge section 18 is a site that transports the recording medium P to the outside and comprises transport roller pairs 72 and 74.

Figure 2:
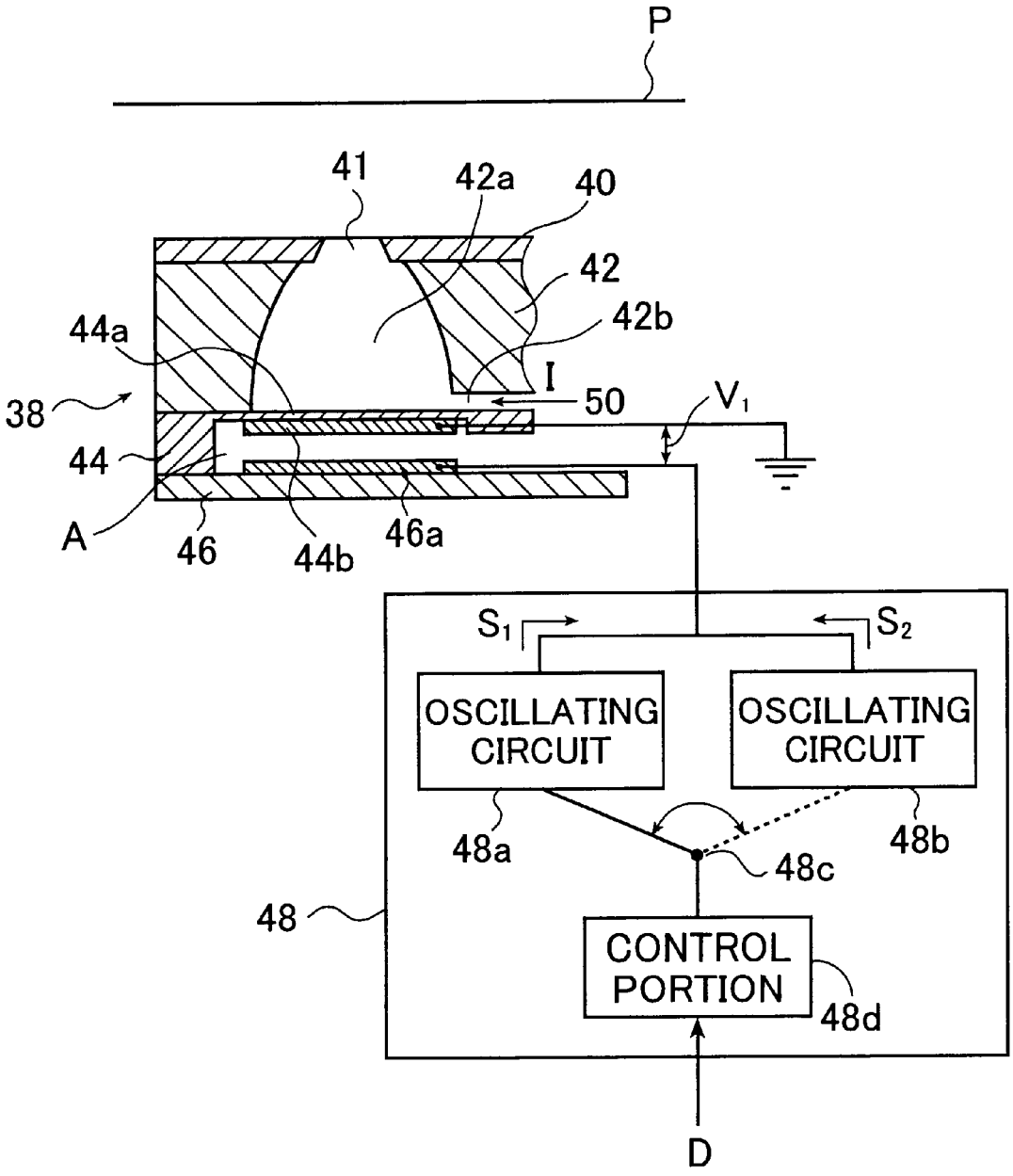
FIG. 2 shows an exemplary cross-sectional structure of the recording head to be used in the printer according to the second aspect of the invention using the image recording method according to its first aspect.

The recording head unit 36 is the characterizing portion of the printer 10 and we now describe it in greater detail with reference to FIG. 2 which shows that part of the recording head 38 in the recording head unit 36 which is associated with one ink nozzle. In FIG. 2, the dimensions of the individual parts are not shown to scale but their thickness is exaggerated.

The recording head 38 shown in FIG. 2 is of a four-layer structure consisting of a nozzle plate 40 and three substrates 42, 44 and 46. The nozzle plate 40 has an ink nozzle 41 through which ink I is ejected as droplet or jetted out as mists for recording with dots. The substrate 42 combines with the nozzle plate 40 and the substrate 44 to form a liquid ink chamber 42*a* and an ink feed channel 42*b*. The liquid ink chamber 42*a* has generally parabolic wall surfaces and the ink feed channel 42*b* is connected to the ink tank 50 so that the ink I is supplied into the liquid ink chamber 42*a*.

The bottom of the liquid ink chamber 42*a* is formed of a diaphragm 44*a* which is a thin-walled portion of the substrate 44. A thin film of moving electrode 44*b* is placed under the diaphragm 44*a* and grounded so that it normally has a voltage of zero volts.

The substrate 46 has a thin film of fixed electrode 46*a* that is parallel to and spaced from the thin film of moving electrode 44*b* at a small distance of, say, 3 $\mu$m.

The thin film of fixed electrode 46*a* is connected to a drive signal generating section 48 via a terminal not shown. The drive signal generating section 48 comprises oscillating circuits 48*a* and 48*b*, a switching circuit 48*c* and a control portion 48*d*. Upon application of a pulsed control voltage signal to the thin film of fixed electrode 46*a*, a voltage difference of $V_1$ develops between the thin film of moving electrode 44*b* and the thin film of fixed electrode 46*a*. Due to their electroconductivity, the thin electrode films 44*b* and 46*a* are charged to different polarities and the resulting electrostatic force acting between the electrodes causes the diaphragm 44*a* to deform convex downward. If the voltage difference $V_1$ is removed in response to a pulsed control voltage signal, the diaphragm 44*a* reverts to its initial shape and the pressure within the liquid ink chamber 42*a* rises abruptly to eject an ink droplet B through the ink nozzle 41. In this way, the diaphragm 44*a* vibrates by deformation and reversion to eject an ink droplet B.

If a control voltage signal having higher frequency component than the above-mentioned control voltage signal, the diaphragm 44*a* vibrates at high enough speed to generate ultrasonic waves within the liquid ink chamber 42*a*. The generated ultrasonic waves converge in the neighborhood of the ink nozzle 41 to produce a sufficient pressure to jet out an ink mist M.

Thus, the diaphragm 44*a*, thin film of moving electrode 44*b* and thin film of fixed electrode 46*a* are configured to form a static capacitance actuator A which selectively eject ink droplets B or jets out ink mists M.

The drive signal generating section 48 comprises the oscillating circuits 48*a* and 48*b*, switching circuit 48*c* and control portion 48*d*. The control portion 48*d* performs gradation transformation on the supplied data D in accordance with a specified scheme and determines from the transformed tone levels of gradation as to whether the pixels to be recorded represent edge portions of a solid level or other portions. If the pixels are not found to represent edge portions of the solid level, the control portion 48*d* drives the switching circuit 48*c* such that it is connected to the oscillating circuit 48*a*. If the pixels are found to represent edge portions of the solid level, the switching circuit 48*c* is driven such that the control portion 48*d* is connected to the oscillating circuit 48*b*.

The oscillating circuit 48*a* is a site at which a control voltage signal $S_1$ to be described below is generated and applied to the actuator A. The oscillating circuit 48*b* is a site at which a control voltage signal $S_2$ to be described below is generated and applied to the actuator A.

To determine whether the pixels to be recorded represent edge portions of the solid level or not, the control portion 48*d* compares the tone level of each pixel of interest with that of pixel which is adjacent to the pixel of interest in the scanning direction of the recording head 38 and concludes that the pixel of interest represents edge portions of a solid level if it has a solid level that differs from the levels of the adjacent pixel by at least a specified value, in the data composed of pixel-based tone levels.

If the pixels of interest are not found to represent edge portions of the solid level, the control voltage signal $S_1$ generated by the oscillating circuit 48*a* varies in accordance with the tone levels of the data D.

Further discussion is made about the control voltage signals $S_1$ and $S_2$ with reference to FIGS. 3A–3D. First, n pulses of a fundamental frequency $f_0(=1/T_0)$ make up a high-frequency signal $S_a$ (see FIG. 3C). A plurality of such high-frequency signals $S_a$ whose number depends on the tone levels of the data D occur in succession at a period of $T_b$ to form a signal $S_b$ (see FIG. 3B). Such signals $S_b$ are formed consecutively at a period of $T_d$ (see FIG. 3A).

Figure 3A:
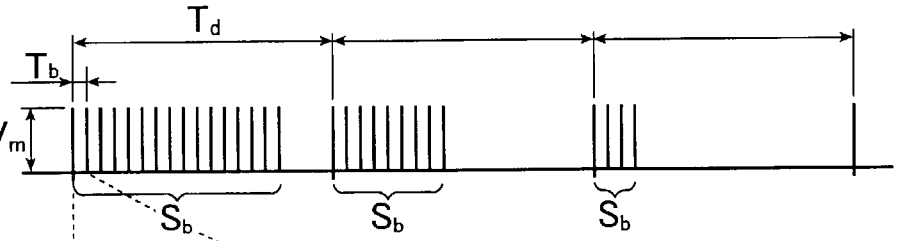
FIGS. 3A–3D show timing charts for the control voltage signals that are generated in the printer of the invention.
Figure 3B:
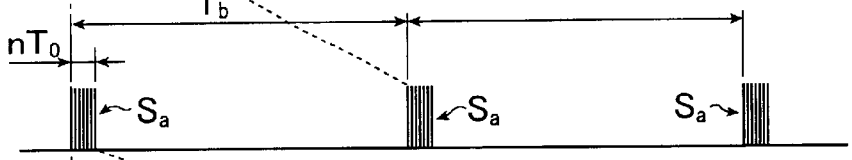
Figure 3C:
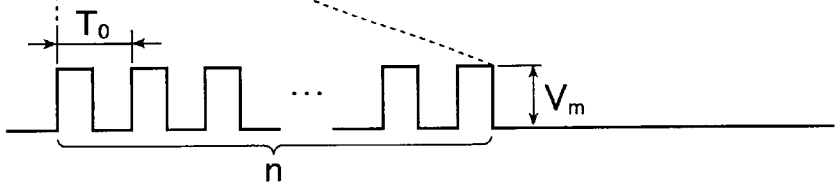
Figure 3D:
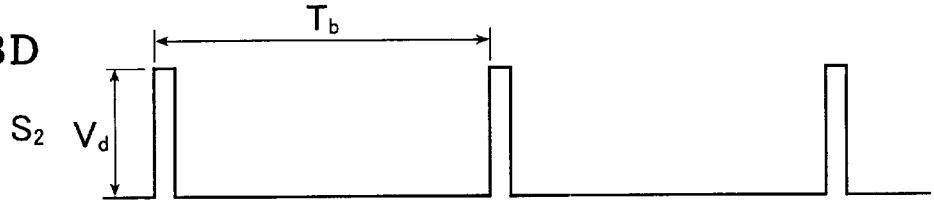

The control voltage signal $S_2$ consists of pulse signals of a given duration that were formed at the period $T_b$ (see FIG. 3D).

Upon receiving the control voltage signal $S_1$, the actuator A jets out an ink mist M through the ink nozzle 41 which consists of fine ink droplets in a volume of about 0.1 pL. Upon receiving the control voltage signal $S_2$, the actuator A ejects an ink droplet through the ink nozzle 41 in a volume of about 1–2 pL.

To give exemplary values of the respective frequencies, $f_0$ is 10 MHz, $f_b$ $(=1/T_b)$ is 60 kHz, and $f_d$ $(=1/T_d)$ is 2 kHz. The voltage $V_d$ of the control voltage signal $S_2$ is higher than the voltage $V_m$ of the control voltage signal $S_1$.

Figure 4A:
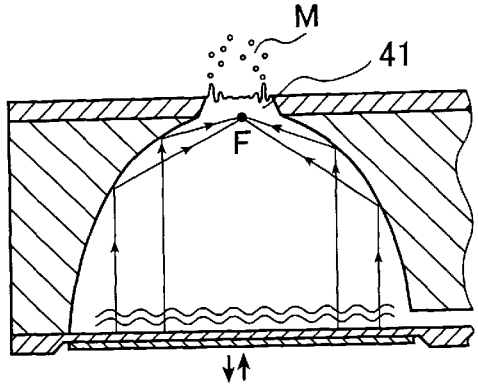
FIG. 4A illustrates how an ink mist is jetted out from the recording head in the printer of the invention.

As already mentioned, the liquid ink chamber 42*a* has parabolic wall surfaces. Upon application of the control voltage signal $S_1$ to the actuator A, the diaphragm 44*a* vibrates at frequency $f_0$ to generate ultrasonic waves which are reflected by the parabolic wall surfaces of the liquid ink chamber 42*a* to converge at the focal point F (see FIG. 4A). The focal point F is in the neighborhood of the ink nozzle 41 so that an ink mist M will be jetted out from the liquid level of ink when the amplitude of the surface waves as excited at said liquid level has become greater than their wavelength.

Since an ink mist M is jetted out from the liquid level of ink upon each application of the high-frequency signal $S_a$, the number of the ink mist jetting corresponds to the number of high-frequency signals $S_a$ contained in the signal component $S_b$ of the control voltage signal $S_1$. As a result, image recording is performed in accordance with the tone levels of the data D.

Figure 4B:
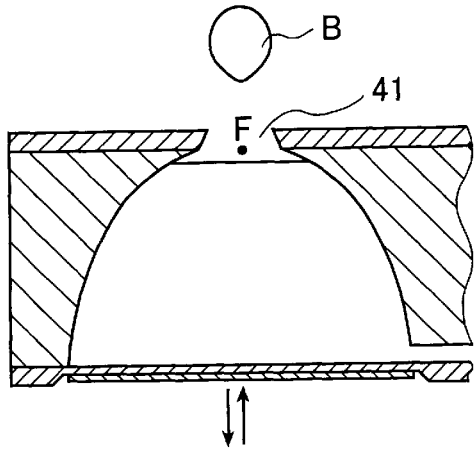
FIG. 4B illustrates how an ink droplet is ejected from the same recording head.

When the actuator is supplied with the control voltage signal $S_2$, the diaphragm 44*a* vibrates at frequency $f_b$ which is lower than frequency $f_0$ at which it vibrates to jet out the ink mist M; as a result, an ink droplet B is ejected from the liquid level in the ink nozzle 41. As already mentioned, the voltage $V_d$ (signal value) of the control voltage signal $S_2$ is higher than the voltage $V_m$ (signal value) of the control voltage signal $S_1$, so the diaphragm 44*a* deforms downward in FIG. 4B by a sufficient amount to bring the liquid level of the ink in the liquid ink chamber 42*a* lower than the focal point F. As a result, the ink droplet B can be easily ejected out through the ink nozzle 41.

In this way, either the ink mist M is jetted out or the ink droplet B is ejected from the liquid ink chamber 42*a* in accordance with the control voltage signal applied.

The recording head in the printer 10 of the embodiment under consideration uses a static capacitance actuator that comprises the diaphragm 44*a,* thin film of moving electrode 44*b* and thin film of fixed electrode 46*a* and which vibrates the diaphragm 44*a* by static electricity. In the present invention, this type of actuator may be replaced by a piezoelectric type which vibrates the diaphragm mechanically in response to control voltage signals.

Figure 5:
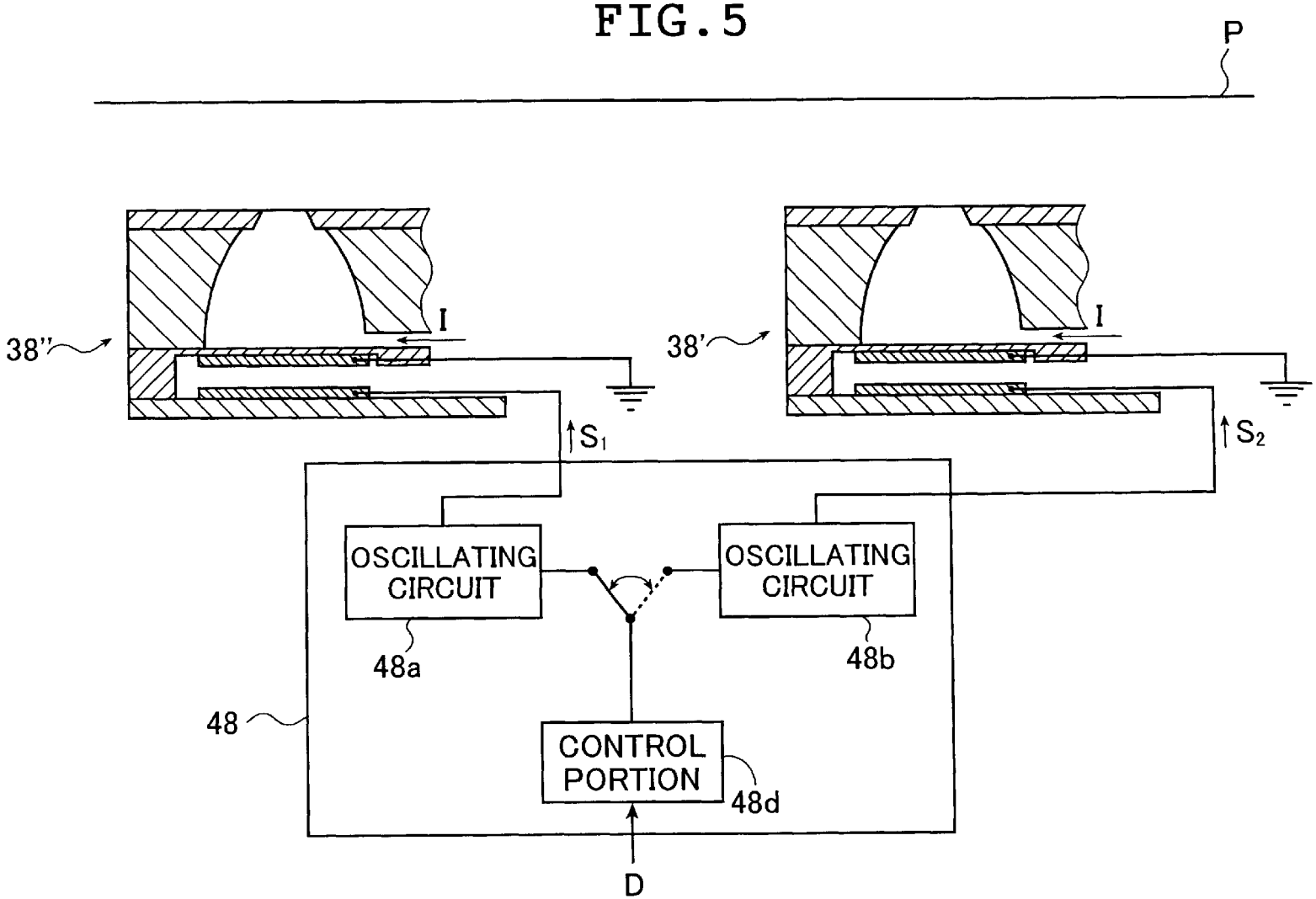
FIG. 5 shows an exemplary cross-sectional structure of the recording head to be used in the printer according to the third aspect of the invention.

The ink recording head in the printer 10 of the embodiment under consideration is a dual functioning type which operates the actuator A to jet out ink mists M or eject ink droplets B through an ink nozzle. Alternatively, as FIG. 5 illustrates, the printer may use at least two recording heads, one being an ink-jet recording head 38' that records edges portions of a solid level by ejecting ink droplets B and the other being an ink-mist recording head 38" that records other portions by jetting out ink mists M. In this alternative case, the ink-jet recording head 38' may be replaced by any known thermal recording heads that perform thermal recording with ink films and the like.

In the printer 10 having the construction described above, the recording medium P as fed transversely into the supply section 14 is gradually transported upward and fed into the preheating section 16; the medium is then heated from the recording surface side by means of the heater 32 as it is held between the conveyor 28 and the pressure roller 30 and forwarded to the recording section 12. In the recording section 12, the recording medium P is sucked and transported by the recording medium transport unit 58, especially by the transport belt 62.

When data D as pixel-based tone level data of gradation is input to the drive signal generating section 48, the signal values of the data D are transformed to tone levels in the drive signal generating section 48 in accordance with a specified transformation scheme. On the basis of the obtained tone levels, individual pixels being scanned to be recorded are determined as to whether they represent edge portions of a solid level or other portions. In the case of 8-bit tone levels of gradation (consisting of 256 levels), pixels of interest that differ from the adjacent pixels by at least 128 levels and which have a level of 255 are found to represent edge portions of the solid level.

If the pixels of interest are found to represent edge portions of a solid tone level, the control portion 48*d* connects the switching circuit 48*c* to the oscillating circuit 48*b,* whereupon the control voltage signal $S_2$ shown in FIG. 3D is generated and applied to the actuator A to form a solid tone of gradation.

If the pixels of interest are not found to represent edge portions of a solid tone level, the control portion 48*d* connects the switching circuit 48*c* to the oscillating circuit 48*a,* whereupon the control voltage signal $S_1$ shown in FIGS. 3A–3C is generated and applied to the actuator A. The signal component $S_b$ in the control voltage signal $S_1$ is a train of high-frequency signals $S_a$ whose number depends on the tone levels of the data D and each of the signals $S_a$ consists of n pulses.

When the control voltage signal $S_1$ is applied to the actuator A, the diaphragm 44*a* vibrates at fundamental frequency $f_0$ to generate ultrasonic waves of ink I in the liquid ink chamber 42*a*. The generated ultrasonic waves are reflected by the wall surfaces of the liquid ink chamber 42*a* and converged at the focal point F so that surface waves are formed at the liquid level of ink which is positioned near said focal point and formed in registry with the nozzle outlet surface. From the neighborhood of a maximum amplitude of these surface waves, an ink mist M composed of fine ink droplets in a volume of about 0.1 pL is jetted out in a trajectory toward the recording medium P. Since the number of high-frequency signals $S_a$ contained in the signal $S_b$ varies with the tone levels of the data D, a plurality of ink mists M are generated in accordance with the tone levels of the data D and jetted out to be deposited on the recording medium P. In this way, portions other than those of a solid level are recorded in the desired tone using the ink mists M.

If the control voltage signal $S_2$ is applied to the actuator A, the diaphragm 44*a* deforms so extensively toward the thin film of fixed electrode 46*a* at frequency $f_b$ that the liquid ink chamber 42*a* is not supplied with an adequate volume of ink I through the ink feed channel 42*b*. As a result, the liquid level of ink falls below the nozzle outlet surface and the focal point F. When the applied voltage droplets to zero volts, the diaphragm 44*a* reverts to its initial shape, pushing the ink I in the liquid ink chamber 42*a* upward. As a result, an ink droplet B is ejected to be deposited on the recording medium P. The pulse duration of the control voltage signal $S_2$ is so determined that the volume of ink droplet B is sufficient to achieve recording of a solid tone image area.

Figure 6A:
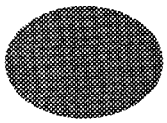
FIGS. 6A, 6B, 6B', 6C, 6D and 6D' show exemplary images that have been recorded by the image recording method of the invention.
Figure 6B:
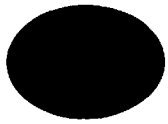
Figure 6B:
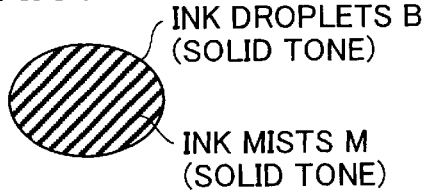
Figure 6C:
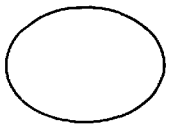

Examples of the image that can be recorded by the method of the invention are shown in FIGS. 6A–6D. Areas of the image that have tones other than a solid tone are recorded with ink mists M (see FIG. 6A). Speaking of areas having the solid tone, the pixels in edge portions of the solid tone level are recorded with ink droplets B and those in non-edge portions, namely, the inside solid areas that are surrounded or sectioned with the edge portions, are recorded with ink mists M (see FIGS. 6B and 6B'). The method of recording the image shown in FIG. 6B is presented more clearly in FIG. 6B'.

Figure 6D:
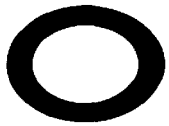
Figure 6D:
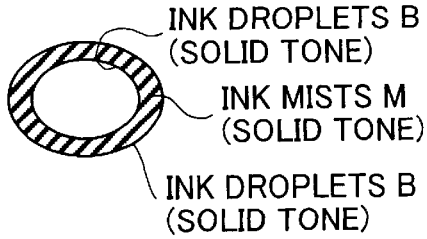

The method of the invention is also applicable to the case of recording characters or line images in the solid tone level. A fine line that is one or two pixels wide is recorded with ink droplets B (see FIG. 6C). As for a thick line three or more pixels wide, only the pixels in edge portions are recorded with ink droplets B and the inside solid areas that are sectioned with the edge portions are recorded with ink mists M (see FIGS. 6D and 6D'). The method of recording the image shown in FIG. 6D is presented more clearly in FIG. 6D'.

The ink I that has been thusly deposited on the recording medium P by printing with the recording head 38 is rapidly dried by the heat applied from the heater 32 to the recording surface of the medium P. The dry recording medium P is further transported and discharged by passage through the transport roller pairs 72 and 74.

Those areas of image which do not have the solid tone level have been recorded with ink mists M and in comparison to the case where only ink droplets B are applied, the image features a better representation of gradation and, hence, better granularity. On the other hand, edge portions of the solid tone level are recorded with ink droplets B to give good enough sharpness. The inside areas of a solid tone level are recorded with ink mists M. Conventionally, image areas of a solid tone level have been recorded with more than necessary volumes of ink in the form of droplets B and this has resulted in slower drying. This problem is solved by the invention and faster drying and, hence, faster printing can be accomplished.

In order to demonstrate the effectiveness of the invention, the present inventors used printer 10 and recorded (printed) four images on paper as shown in FIGS. 6A, 6B, 6C and 6D, with edge portions of a solid tone level being recorded with ink droplets B and the other portions with ink mists M (Example 1). The drying speed of the deposited ink and the sharpness of the edge portions of the images were evaluated. The ink nozzles 41 in the recording head 38 had a diameter of 50 $\mu$m. Printing (recording) was done at a dot density of 300 dpi and at frequency $f_b$ of 64 kHz. Dots were considered to form edge portions at 300 dpi.

The same experiment was repeated except that all images were recorded with ink mists M (Comparative Example 1) or ink droplets B (Comparative Example 2).

Two seconds after printing, the images were touched with a forefinger. The drying speed was concluded ENOUGH when the finger was not stained with the ink but it was found NOT ENOUGH when the finger was stained with the ink. The sharpness of the edge portions was evaluated by visual inspection. The result was found GOOD when the edge portions could be recognized sharply but it was found NO GOOD when the edge portions were blurred. See Table 1 below.

TABLE 1

| | Edge portions of solid tone level | Other portions | Drying speed | Sharpness of edge portions |
|---|---|---|---|---|
| Example 1 | ink droplets | ink mists | enough | good |
| Comparative Example 1 | ink mists | ink mists | enough | no good |
| Comparative Example 2 | ink droplets | ink droplets | not enough | good |

As is clear from Table 1, the image recording method of the invention permits faster ink drying and printing of sharper edge portions of image.

While the image recording method of the invention and the printer for implementing it have been described above in detail, it should be understood that the invention is by no means limited to the foregoing embodiments and various improvements and modifications can of course be made without departing from the scope and spirit of the invention.

In the invention, those areas of an image which are not edge portions of a solid tone level are recorded with ink mists M, so they feature better granularity. On the other hand, the edge portions of the solid tone level are recorded with ink droplets B to give high enough sharpness. The inside areas of a solid tone level are recorded with ink mists M and this contributes to faster drying and, hence, faster printing.

What is claimed is:

1. An image recording method for recording an image having edge portions of a solid tone level of gradation therein, having steps of;

recording the edge portions with dots to form a solid tone;

recording portions in the image other than the edge portions using ink mists that are generated by converging ultrasonic waves in ink.

2. The image recording method according to claim 1, wherein the edge portions are recorded using ink droplets.

3. A printer comprising:

a recording head which ejects ink droplets or jets out ink mists selectively, depending upon input data of an image; and a selector receiving the input data and supplying the recording head with a signal to jet out one of the ink droplets and the ink mists.

4. The printer according to claim 3, which has a drive signal generating section which, depending upon the input data, generates a first drive signal for causing the recording head to eject ink droplets or a second drive signal for causing the recording head to jet out ink mists and the drive signal generating section applies either the first drive signal or the second drive signal to the recording head.

5. The printer according to claim 4, wherein the drive signal generating section generates the first drive signal for edge portions of a solid tone level of gradation in the image to be recorded and generates the second drive signal for portions other than the edge portions.

6. The printer according to claim 5, wherein the first drive signal has lower frequency than the second drive signal.

7. The printer according to claim 6, wherein the recording head has liquid ink chambers each of which has an ink nozzle through which ink droplets are ejected or ink mists are jetted out selectively, and wherein signal values of the first drive signal and the second drive signal are controlled such that a liquid level of ink in each liquid ink chamber is brought into registry with an outlet surface of the ink nozzle when the second drive signal is applied to the recording head whereas the liquid level in the liquid ink chamber is made lower than the outlet surface of each ink nozzle when the first drive signal is applied to the recording head.

8. The printer according to claim 5, wherein the edge portions are detected on pixel basis of the image to find pixels which differ from adjacent pixels by tone level of gradation exceeding a specified value.

9. A printer having at least two recording heads, a first being a recording head which records edge portions of a solid tone level of gradation in an image to be recorded with dots to form a solid tone, and a second being a recording head which records portions in the image other than the edge portions using ink mists that are generated by converging ultrasonic waves in ink.

10. The printer according to claim 9, wherein the edge portions are detected on pixel basis of the image to find pixels which differ from adjacent pixels by tone level of gradation exceeding a specified value.

* * * * *